US006166706A

United States Patent [19]

Gallagher, III et al.

[11] Patent Number: 6,166,706

[45] Date of Patent: Dec. 26, 2000

[54] ROTATING FIELD ANTENNA WITH A MAGNETICALLY COUPLED QUADRATURE LOOP

[75] Inventors: William F. Gallagher, III, Phoenixville, Pa.; Russell E. Barber, Thorofare, N.J.

[73] Assignee: Checkpoint Systems, Inc., Thorofare, N.J.

[21] Appl. No.: 09/187,300

[22] Filed: Nov. 4, 1998

[51] Int. Cl.[7] ..... H01Q 21/00

[52] U.S. Cl. ..... 343/867; 343/741; 343/742; 343/866

[58] Field of Search ..... 343/866, 867, 343/741, 742; 340/572; H01Q 21/00

[56] References Cited

U.S. PATENT DOCUMENTS

| | | | |
|---|---|---|---|
| 5,103,235 | 4/1992 | Clemens | 343/742 |
| 5,371,490 | 12/1994 | Martinides | 340/572 |
| 5,602,556 | 2/1997 | Bowers | 343/742 |
| 5,663,738 | 9/1997 | Mueller | 343/742 |
| 5,825,291 | 10/1998 | Platt et al. | 340/572 |
| 5,963,173 | 10/1999 | Lian et al. | 343/742 |

*Primary Examiner*—Don Wong
*Assistant Examiner*—Shih-Chao Chen
*Attorney, Agent, or Firm*—Akin, Gump, Strauss, Hauer & Feld, L.L.P.

[57] ABSTRACT

A rotating field antenna is provided which includes a figure eight shape loop, a center loop magnetically coupled to the figure eight shape loop, and a drive element for driving the figure eight loop. The figure eight shape loop has an upper loop, a lower loop and a crossover region therebetween. The center loop overlaps at least a portion of the crossover region and at least a portion of one or both of the upper and lower loops. The center loop has no direct or physical electrical connection to the offset figure eight shape loop. Magnetic induction produces a 90-degree phase difference between the phase of the figure eight loop and the phase of the center loop. The antenna thereby produces a rotating composite field when driven by the drive element. The figure eight loop and the center loop are coplanar. The drive element may be an amplified voltage source which has a fundamental frequency of about 13.56 MHz, thereby providing a multiple loop antenna which is useful for electronic article surveillance systems that use RFID tags which resonate at 13.56 MHz.

13 Claims, 2 Drawing Sheets

ROTATING FIELD ANTENNA WITH A MAGNETICALLY COUPLED QUADRATURE LOOP

BACKGROUND OF THE INVENTION

The present invention relates to radio frequency antennas and more particularly, to loop antennas which generate a rotating field.

In certain types of electronic systems it is known to provide one or more loop antennas wherein coupling between an antenna and its proximate surrounding is high, but wherein the design of the antenna is such that coupling between the antenna and its distant surrounding (i.e., about one wavelength or more distant from the antenna) is minimized. Such antennas are generally used for near-field communications or sensing applications where the term "near field" means within one half wavelength of the antenna. Examples of such applications include communications with implanted medical devices, short range wireless local area communications networks for computers and radio frequency identification systems including electronic article surveillance (EAS) systems. Generally, the coupling to these loop antennas is primarily via magnetic induction.

For example, radio frequency identification (RFID) systems usually include both a transmit antenna and a receive antenna which collectively establish a detection zone, and tags which are attached to articles being protected. The transmit antenna generates an electromagnetic field which may be fixed or variable within a small range of a first predetermined frequency. The tags each include a resonant circuit having a predetermined resonant frequency generally equal to the first frequency. When one of the tags is present in the detection zone, the field generated by the transmit antenna induces a voltage in the resonant circuit in the tag, which causes the resonant circuit to resonate and thereby generate an electromagnetic field, causing a disturbance in the field within the detection zone. The receive antenna detects the electromagnetic field disturbance, which may translate to item identification data related to the protected article attached to the tag in the detection zone. Special antenna configurations have been designed for such purposes.

One conventional antenna has a two loop, figure eight configuration. In such a two loop antenna, a weak detection field or "hole" occurs at the center of the detection zone, which is the zone generally parallel to the crossover of the loops of the figure eight. The hole is especially prominent when the tag is oriented in a position that is normal or perpendicular to the axis of the crossbar.

A three loop antenna is commonly used to address the issue of weak field production in the center zone. However, a three loop antenna which is large enough to cover a volume of several cubic meters will have a self-resonance below 13.56 MHz, which is a desired frequency for certain tag applications. Accordingly, such an antenna cannot be tuned to 13.56 MHz.

One conventional technique for developing the field in the center zone is by simply driving a center loop with the same current source as the primary loop. However, this technique is not optimum, since "hot" and "cold" areas develop from positive reinforcement and destructive cancellation, respectively, due to field components of the figure eight and center loop with opposite polarity. By rotating the field, the antenna basically averages the hot and cold spots, and provides uniform field production.

Another conventional technique for generating a rotating field is to drive the center loop 90 degrees out of phase with respect to the other loops using a series/parallel matching network.

Both of these conventional schemes for providing a rotating, uniform field require that the center loop be electrically connected to the figure eight loop. One conventional connection scheme is to electrically connect the center loop to the figure eight loop through a phase shifting network. The phase shifting network adds cost and complexity to the antenna. Also, losses in the network components reduce the efficiency of the antenna.

Accordingly, there is a need for a rotating field antenna which does not require such an electrical connection and which is well-suited for radio frequencies in the range of 13.56 MHz. The present invention fulfills these needs.

BRIEF SUMMARY OF THE INVENTION

A multiple loop antenna is provided which comprises a loop having a figure eight shape and including a crossover region, a drive element for driving the figure eight loop, and a center loop overlapping at least a portion of the crossover region. The center loop also overlaps at least a portion of the figure eight loop. The center loop has no direct or physical electrical connection to the figure eight loop or to the drive element. Magnetic induction produces a 90 degree phase difference between the phase of the figure eight loop and the phase of the center loop. The antenna thereby produces a rotating composite field when driven by the drive element.

BRIEF DESCRIPTION OF THE DRAWING

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Certain terminology is used herein for convenience only and is not to be taken as a limitation on the present invention.

Figure 1:
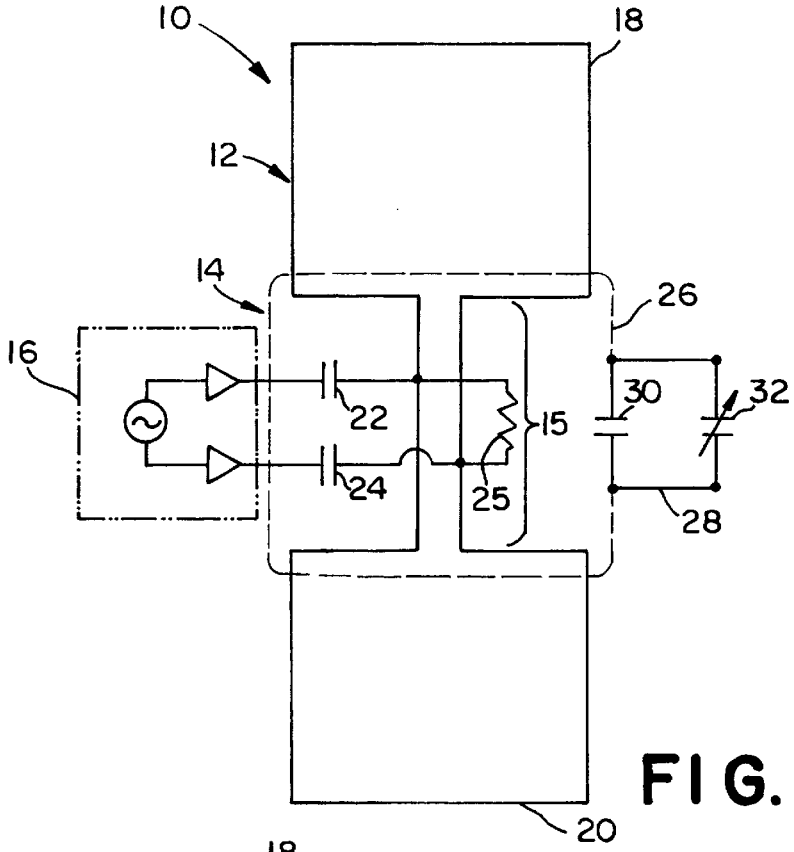
FIG. 1 is a schematic diagram of a rotating field antenna in accordance with a preferred embodiment of the present invention.

FIG. 1 is a resonant loop antenna 10 in accordance with one preferred embodiment of the present invention. The antenna 10 produces a magnetic field in all planes. The antenna 10 develops a rotating composite field by driving one or more of the antenna loops with a 90 degree phase difference relative to at least one of the other loops. Contrary to conventional schemes, magnetic induction is used to produce the 90 degree phase difference between the loops, and there is no direct or physical electrical connection to the element (or elements) that generates the zero degree, or reference, field.

The antenna 10 is generally defined by two loops, namely, a first figure eight loop antenna 12 (hereafter, "figure eight loop 12") shown in solid lines and a second center loop antenna 14 (hereafter, "center loop 14") shown in dashed lines. The figure eight loop 12 has an upper loop portion 18 and a lower loop portion 20 connected in parallel with each other. A figure eight loop has a "crossover" or "crossover region 15" which is defined herein as the space or region between the bottom of the upper loop portion 18 and the top of the lower loop portion 20. In the preferred embodiment of the present invention, the antenna 10 is an offset figure eight loop antenna (i.e., the upper loop portion 18 is significantly offset from the lower loop portion 20), thereby defining a dumbbell shape. However, the figure eight loop may also have a conventional, non-offset configuration.

Figure 2A:
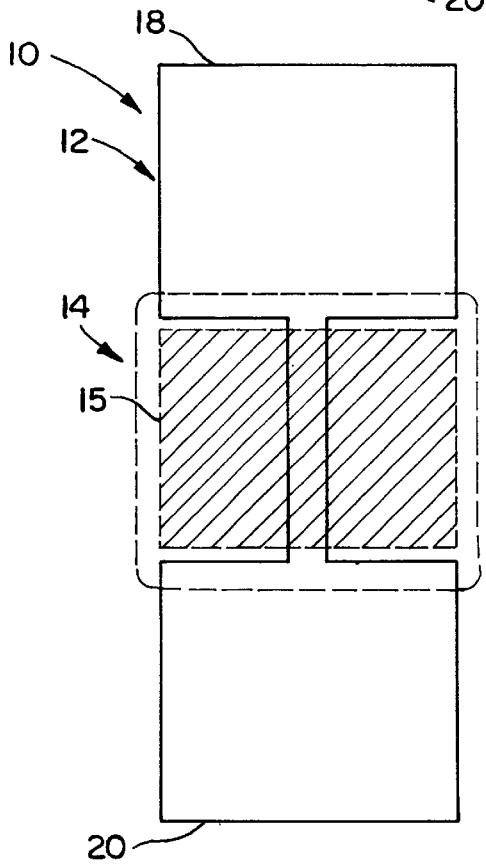
FIGS. 2A–2D are antenna configurations in accordance with four different embodiments of the present invention.
Figure 2B:
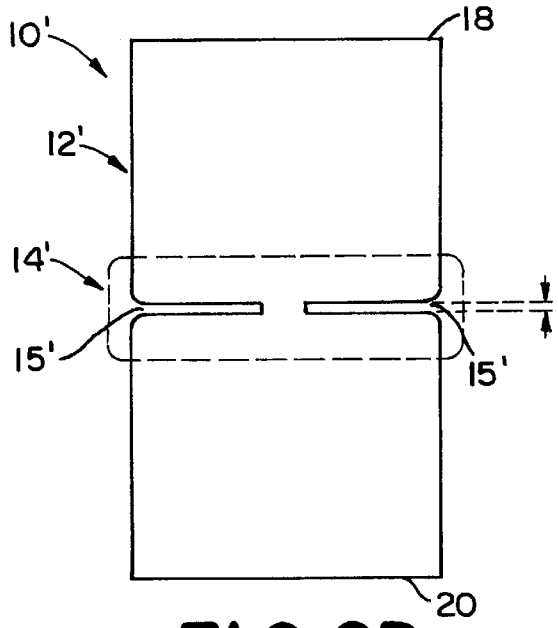

FIG. 2A illustrates the offset figure eight loop antenna 10 having a hatched crossover region 15 of significant area, as configured in FIG. 1. FIG. 2B illustrates a non-offset figure eight loop antenna 10' having a crossover region 15'. In the non-offset configuration, the crossover region 15' has only a small area and resembles a line, instead of a rectangle. The height of the crossover region 15 is preferably about ⅓ to about ½ of the height of the entire antenna 10, and even more preferably, is about ⅓ of the height of the entire antenna 10. However, as shown in FIG. 2B, the height of the crossover region 15' may be very small, and may therefore be a negligible percentage of the height of the entire antenna 10'.

Figure 2C:
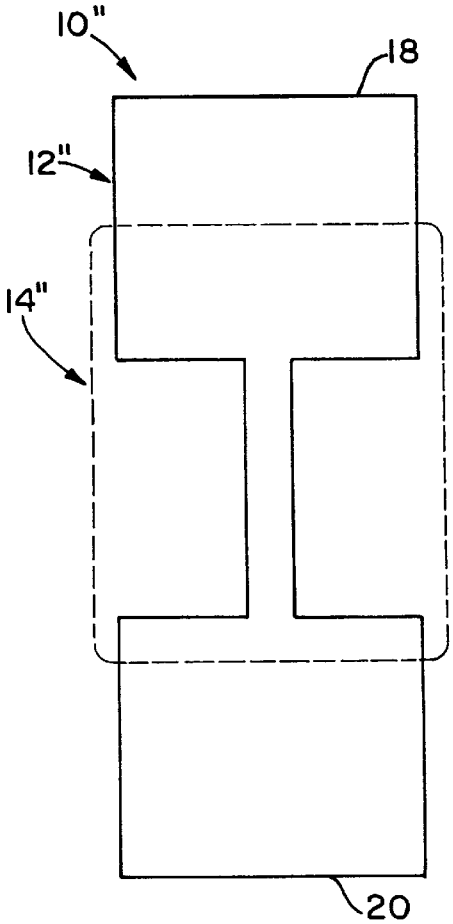
Figure 2D:
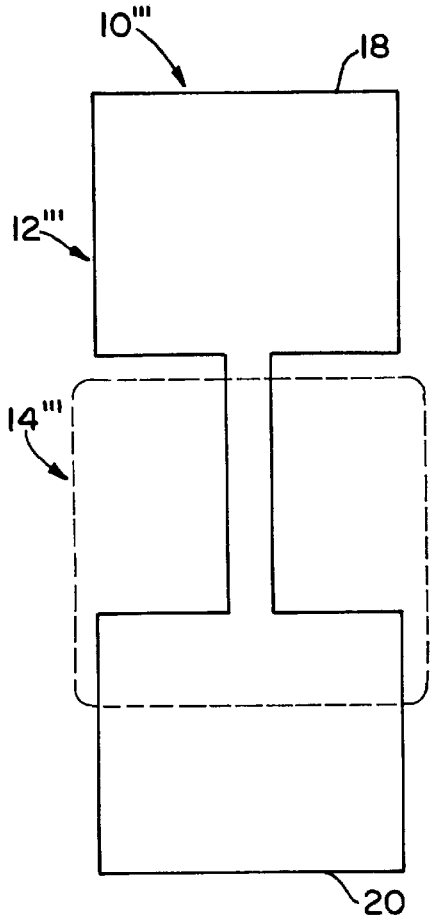

The center loop 14 overlaps at least a portion of the area of the crossover region 15 and at least a portion of the figure eight loop antenna 12. More specifically, the center loop 14 overlaps at least a portion of the area of the crossover region 15, as well as at least a portion of the area of one or both of the upper loop portion 18 and the lower loop portion 20. Preferably, the center loop 14 overlaps the entire area of the crossover region 15, as well as a bottom area of the upper loop portion 18 and a top area of the lower loop portion 20, as shown in FIGS. 1, 2A and 2B. Preferably, the center loop 14 overlaps one loop portions slightly more than the other loop portion, as shown in FIGS. 1, 2A and 2B, wherein the center loop 14 overlaps the upper loop portion 18 slightly more than the lower loop portion 20. Preferably, the area of overlap of one loop portion is about 10% to about 20% more than the area of overlap of the other loop portion. However, the scope of the invention includes embodiments where the center loop 14 overlaps one loop portion significantly more than the other loop portion, as shown in FIG. 2C, as well as embodiments where the overlap is equal (not shown). Furthermore, the center loop 14 may also overlap the entire area, or a portion of the area, of the crossover region 15, as well as only a portion of the area of the upper or lower loop portions 18 or 20. For example, FIG. 2D shows an antenna 10''' wherein the center loop 14''' overlaps only a portion of the area of the crossover region 15''', and only the top area of the lower loop portion 20. In FIG. 2D, the center loop antenna 14''' does not overlap any area of the upper loop portion 18.

The center loop 14 is generally coplanar with the figure eight loop 12. However, the center loop 14 will be slightly offset from the figure eight loop 12 due to the wire thickness of the figure eight loop 12, and the fact that a top and/or bottom portion of the center loop 14 slightly overlaps some area of the figure eight loop 12. That is, wire crossovers prevent perfect coplanarity between the center loop 14 and the figure eight loop 12. The loops 18 and 20 of the figure eight loop 12 and the center loop 14 may be generally rectangular or may have other loop-type shapes (e.g., oval, round, or combinations thereof).

Referring again to FIG. 1, the figure eight loop 12 is driven by an amplified voltage source 16 shown within dotted/dashed lines. Alternatively, the figure eight loop 12 may be driven by an amplified current source (not shown). The figure eight loop 12 is in a series resonant circuit with a combination of resonating/tuning capacitors 22 and 24, so that a voltage boost occurs across the terminals of the figure eight loop 12 due to the Q of the resonant circuit. The resonating capacitors 22 and 24 are connected at one end to the respective polarities of the voltage source 16 and are connected at the other end to respective ends of a resistor 25.

The center loop 14 is not driven by a direct or physical electrical connection to the voltage source 16. Rather, it is positioned in such a manner that a controlled portion of the magnetic flux of the figure eight loop 12 is intercepted by the center loop 14. The center loop 14 is a series resonant circuit comprising a loop inductor 26 and at least one capacitance 28. The series capacitance 28 is preferably comprised of a parallel combination of one fixed capacitor 30 and one tunable capacitor 32.

In the resultant antenna structure 10, the voltage source 16 drives current in the figure eight loop 12, which emanates a time varying magnetic field therefrom. With the figure eight loop 12 alone, the established field is relatively weak in the center region. By filling in the center region with a center loop 14, the antenna 10 can launch a composite rotating field, resulting from the vector sum of a primary time varying magnetic field with a secondary field, at the same frequency as the primary field and 90 degrees out of phase with respect to the primary field.

Magnetic induction is used to generate a time varying voltage, e(t), across the center loop 14, due to a time varying magnetic flux, $\phi$ (t), through N turns. When the time varying flux, $\phi(t)$, is given by $\sin(\omega t+\theta)$, $\phi(t)=\sin(\omega t+\theta)$ and $e(t)=N\omega\cos(\omega t+\theta)$, then the induced voltage is given by $N\omega\cos(\omega t+\theta)$, thereby causing the 90 degree phase shift.

The resultant field rotates at the fundamental frequency of operation. The mechanics of the field summation are analogous to an electric motor driven with quadrature fields. Thus, the term "rotating" field is appropriate.

The voltage boost of the center loop 14 is given by the quality factor, Q, of the series resonant circuit. The overlap of the center loop 14 and the figure eight loop areas 18 and 20 is then empirically determined to provide balanced composite field production and resonant tag detection.

In one preferred embodiment of the present invention, the antenna 10 interrogates radio frequency identification (RFID) tags. RFID tags are detected when presented to a pair of antennas that form an aisle at an entrance or exitway. The antenna 10 is preferably used in a floor exit antenna. However, other antenna configurations, including hand-held RFID scanners, are within the scope of the invention. One conventional RFID tag suitable for use with the present invention has a primary resonant frequency or fundamental frequency of about 13.56 MHz. Thus, the antenna has a fundamental frequency of about 13.56 MHz, and the voltage source 16 has a fundamental frequency of about 13.56 MHz. Although it is preferred that the antenna's fundamental frequency is about 13.56 MHz, other radio frequencies, including microwave frequencies, are within the scope of the invention.

The antenna 10 is better than conventional two loop, figure eight antennas because it fills in "holes" in the antenna detection pattern. The antenna 10 also does not suffer from the disadvantages of conventional three loop antennas which use a phase shifting network to strengthen signal production in the center zone, since no such network is needed. Also, a three loop antenna of sufficient size to cover an entrance or exitway has self-resonance above 13.56 MHz. Thus, unlike a conventional three loop antenna of such size, an antenna constructed in accordance with the present invention can be tuned to 13.56 MHz by appropriate addition of fixed and/or variable capacitance.

The antenna 10 is particularly useful in RFID-based security systems. The antenna 10 may serve as part of a long-range read antenna system which can operate within the constraints set by regulatory agencies with respect to field emissions, while providing adequate detection performance for all possible tag/antenna orientations. The high Q, single frequency operation of the antenna 10 lends itself to the loose magnetic coupling/Q boost technique.

This technique cannot be used in broadband systems that have low Q. In such systems, the coupling overlap would have to be very high, which means that the center loop would have to be large. A large single loop system does not cancel its far field component, and does not provide for optimum radiated emissions.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A multiple loop antenna comprising:

(a) a loop having a figure eight shape, the loop having an upper loop and a lower loop connected in parallel with each other, the loop including a crossover region between the bottom of the upper loop and the top of the lower loop;

(b) a drive element for driving the figure eight loop; and (c) a center loop overlapping only a portion of the crossover region and a portion of the figure eight loop, wherein the center loop has no direct or physical electrical connection to the figure eight loop or to the drive element, and wherein magnetic induction produces a 90 degree phase difference between the phase of the figure eight loop and the phase of the center loop, the antenna thereby producing a rotating composite field when driven by the drive element.

2. The multiple loop antenna according to claim 1 wherein the center loop includes a bottom area which overlaps a top area of the lower loop.

3. The multiple loop antenna according to claim 2 wherein the center loop further includes a top area which overlaps a bottom area of the upper loop.

4. The multiple loop antenna according to claim 3 wherein the area of overlap of the center loop and one of the upper and lower loops is about 10% to about 20% greater than the area of overlap of the center loop and the other of the upper and lower loops.

5. The multiple loop antenna according to claim 1 wherein the drive element is an amplified voltage source.

6. The multiple loop antenna according to claim 5 wherein the voltage source has a fundamental frequency of about 13.56 MHz.

7. The multiple loop antenna according to claim 1 wherein the center loop is a series resonant circuit comprising a loop inductor and a capacitance.

8. The multiple loop antenna according to claim 7 wherein the capacitance is a parallel combination of a fixed capacitor and a tunable capacitor.

9. The multiple loop antenna according to claim 1 wherein the drive element is an amplified current source.

10. The multiple loop antenna according to claim 1 wherein the height of the crossover region is about ⅓ to about ½ of the height of the entire antenna.

11. The multiple loop antenna according to claim 1 wherein the figure eight loop and the center loop are coplanar.

12. A rotating field antenna comprising:

(a) a figure-8 shape loop, the figure-8 shape loop being an offset figure-8 shape loop having an upper loop, a lower loop and a crossover region therebetween;

(b) a single drive element for driving the figure-8 loop; and (c) a center loop magnetically coupled to the figure-8 shape loop whereby the center loop overlaps only a portion of the crossover region and a portion of one or both of the upper and lower loops, and the center loop has no direct or physical electrical connection to the offset figure eight shape loop.

13. The rotating field antenna according to claim 12 wherein the area of overlap of the center loop and one of the upper and lower loops is about 10% to about 20% greater than the area of overlap of the center loop and the other of the upper and lower loops.

* * * * *